US010076165B2

(12) United States Patent
Fogel

(10) Patent No.: US 10,076,165 B2
(45) Date of Patent: Sep. 18, 2018

(54) BRIDAL SET JEWELRY SYSTEM WITH INTERCHANGEABLE HEADS, SHANKS AND BANDS

(71) Applicant: KF Licensing, Inc., Millburn, NJ (US)

(72) Inventor: Kenneth Fogel, Millburn, NJ (US)

( * ) Notice: Subject to any disclaimer, the term of this patent is extended or adjusted under 35 U.S.C. 154(b) by 0 days.

(21) Appl. No.: 14/477,225

(22) Filed: Sep. 4, 2014

(65) Prior Publication Data

US 2015/0059403 A1 Mar. 5, 2015

Related U.S. Application Data

(60) Provisional application No. 61/873,614, filed on Sep. 4, 2013.

(51) Int. Cl.

| | |
|---|---|
| ***A44C 9/00*** | (2006.01) |
| ***A44C 17/02*** | (2006.01) |
| ***A44C 27/00*** | (2006.01) |

(52) U.S. Cl.

CPC ..... *A44C 17/0233* (2013.01); *A44C 9/00* (2013.01); *A44C 9/0007* (2013.01); *A44C 27/00* (2013.01); *Y10T 29/49593* (2015.01)

(58) Field of Classification Search

CPC . A44C 17/0208; A44C 17/0233; A44C 17/02; A44C 9/00; A44C 9/0007; A44C 9/0015; A44C 9/0023

See application file for complete search history.

(56) References Cited

U.S. PATENT DOCUMENTS

| | | | | |
|---|---|---|---|---|
| 1,179,025 | A | 4/1916 | Molinaro | |
| 1,186,271 | A | 6/1916 | Block | |
| 1,864,371 | A | 6/1932 | Prussian | |
| 2,316,225 | A | 4/1943 | Hoffman | |
| 2,775,878 | A | 1/1957 | Eichhorn | |
| 4,519,220 | A | 5/1985 | Burrell | |
| 5,069,045 | A | 12/1991 | Mejias | |
| 5,491,986 | A | 2/1996 | White | |
| 2006/0032270 | A1* | 2/2006 | Doyno | A44C 17/0233 63/29.1 |
| 2006/0288734 | A1* | 12/2006 | Savransky | A44C 17/0216 63/15 |
| 2007/0214832 | A1* | 9/2007 | Fogel | A44C 9/0023 63/15.4 |
| 2008/0289363 | A1* | 11/2008 | Langford | A44C 9/00 63/1.16 |

FOREIGN PATENT DOCUMENTS

| | | | |
|---|---|---|---|
| WO | 199622714 | A1 | 8/1996 |

* cited by examiner

*Primary Examiner* — Abigail E Troy
(74) *Attorney, Agent, or Firm* — Fox Rothschild LLP

(57) ABSTRACT

A ring assembly including a shank having a band defining a head mounting area with a through hole defined through the band in the head mounting area. The through hole defines internal threads; and a head including a mount with a post extending therethrough, the post including an area of external threads configured to engage the internal threads to releasably secure the head to the shank. Methods for forming and demonstrating ring assemblies are also disclosed.

7 Claims, 5 Drawing Sheets

BRIDAL SET JEWELRY SYSTEM WITH INTERCHANGEABLE HEADS, SHANKS AND BANDS

CROSS REFERENCE TO RELATED APPLICATIONS

This application claims the benefit of U.S. Provisional Patent Application Ser. No. 61/873,614, filed on Sep. 4, 2013, the contents of which applications are incorporated herein by reference.

FIELD OF THE INVENTION

This invention relates to jewelry. More particularly, the invention relates to bridal set jewelry with interchangeable heads, shanks and bands.

BACKGROUND OF THE INVENTION

One major problem in the retail fine jewelry industry is that inventory is very expensive and slow turning, making cost of inventory and old inventory a major cost component in selling fine jewelry. Bridal sets are particularly costly to stock, consisting of a matching engagement ring and wedding band, with the engagement ring including a head, which supports the diamond, and a shank, which is a band with a surface adapted to receive the head. As such, the set consists of three components, which makes it difficult for the jeweler to stock many combinations.

For example, if a jeweler wanted to stock complete bridal sets of 18 combinations of styles, this requires 18 varieties of heads, 18 varieties of shanks and 18 varieties of bands. There would be 5,832 possible combinations; that is, 5,832 bridal sets to stock. Until now, jewelers have had to compromise and sacrifice either cost or variety of selection.

SUMMARY OF THE INVENTION

The present invention provides customizable and interchangeable bridal sets to maximize choice and minimize inventory cost for the jewelry retailer and also allow for maximum ease of manufacturing many styles with minimal modeling and manufacturing costs. Accordingly, a screw mechanism has been developed to allow customers to temporarily screw heads in and out of various shanks in a secure yet easily reversible manner. This system allows for mass in-person customization of bridal jewelry sets, with customers as the ultimate designers of sets that appeal to their desire for a unique bridal set combination. As an added benefit, consumers design their bridal set by using actual jewelry pieces combined and viewed on their hand, instead of by viewing a CAD display on a computer screen.

In at least one embodiment, the present invention provides a ring assembly including a shank having a band defining a head mounting area with a through hole defined through the band in the head mounting area. The through hole defines internal threads; and a head including a mount with a post extending therethrough, the post including an area of external threads configured to engage the internal threads to releasably secure the head to the shank.

In at least one embodiment, the present invention provides a method of forming a ring assembly with interchangeable heads and shanks.

In at least one embodiment, the present invention provides a ring assembly kit for demonstrating various ring assembly combinations. The kit includes a plurality of shanks with each shank having a band defining a head mounting area with a through hole defined through the band in the head mounting area, the through hole defining internal threads. The kit further includes a plurality of heads with each head including a mount with a post extending therethrough, the post including an area of external threads configured to engage the internal threads of one of the plurality of shanks to releasably secure the respective head to the respective shank.

In at least one embodiment, the present invention provides a method of demonstrating various ring assemblies comprising a head and a shank, the method includes selecting a first shank from a plurality of shanks, each shank having a band defining a head mounting area with a through hole defined through the band in the head mounting area, the through hole defining internal threads; and selecting a first head from plurality of heads, each head including a mount with a post extending therethrough, the post including an area of external threads; and threadably interconnecting external threads of the first head with the internal threads of the first shank to releasably secure the first head to the first shank.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
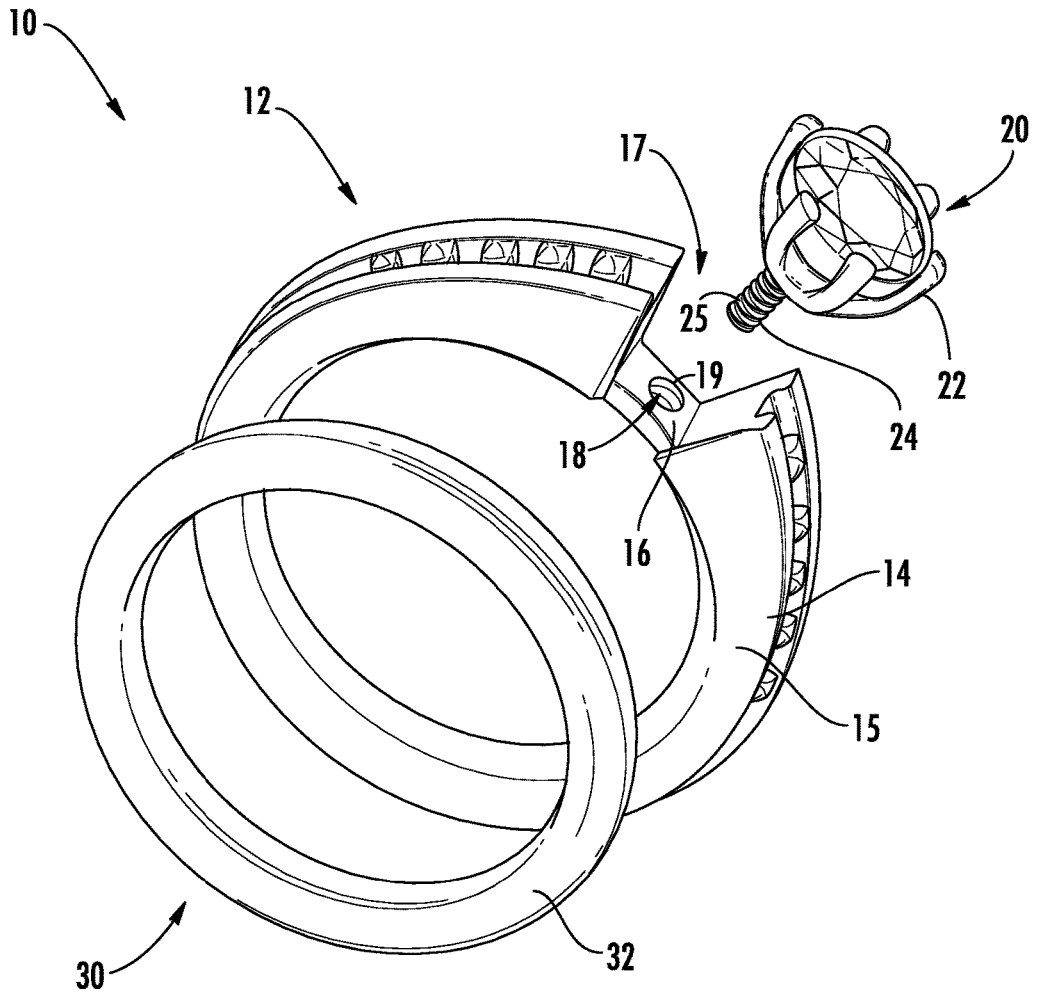
FIG. 1 is a perspective view an exemplary interchangeable bridal set in accordance with an embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
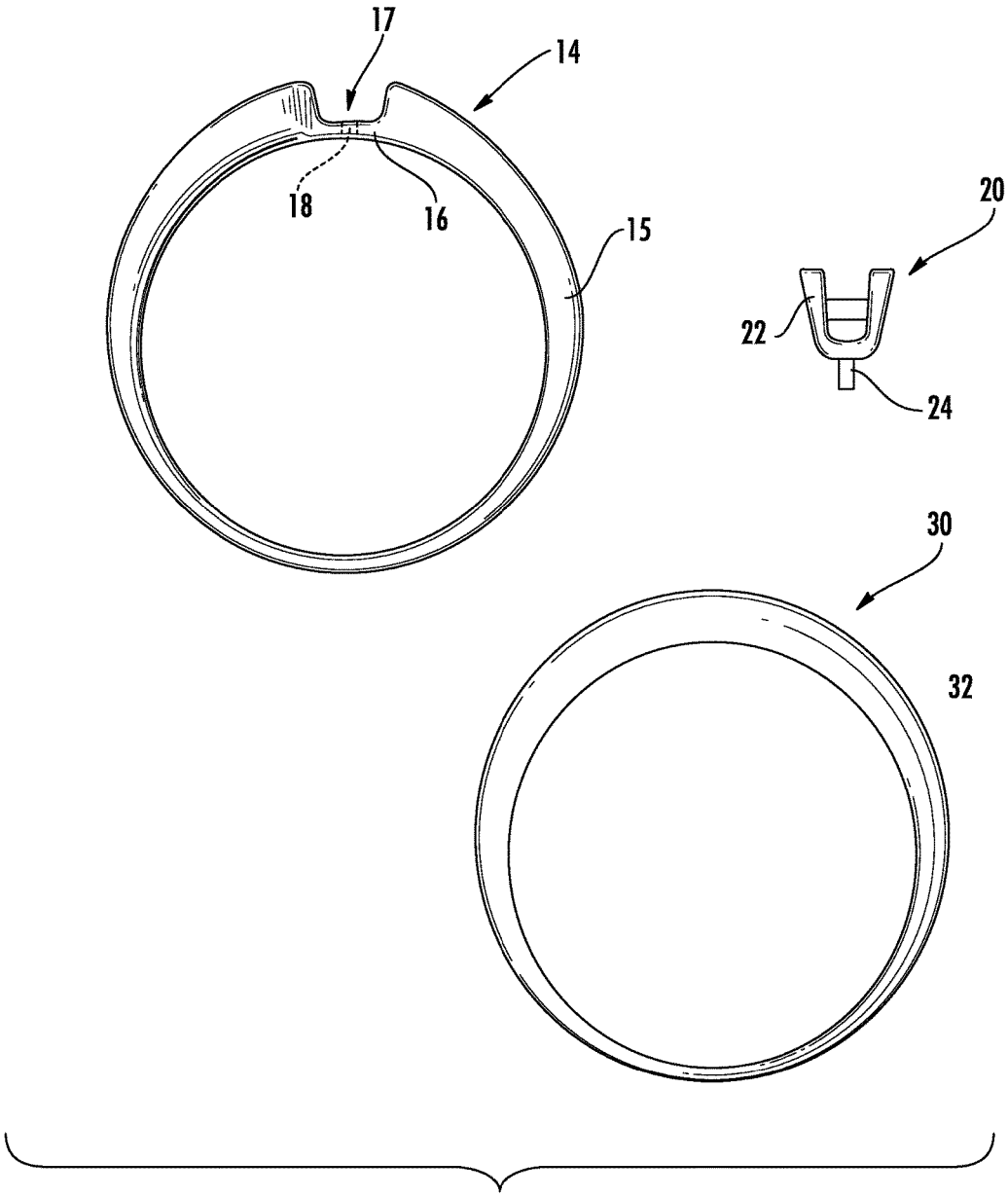
FIG. 2 is a side elevation view of each of the separate components of an exemplary bridal set in accordance with an embodiment of the invention.

Referring to FIGS. 1 and 2, an exemplary bridal set 10 in accordance with the invention includes an engagement ring 12 and a wedding band 30. While the invention is described herein with respect to a bridal set, the invention is not limited to such and may encompass varies ring assemblies including an interconnected shank and head, with or without a complementary separate band, which may be used for any purpose, not just nuptials. The system described herein works equally well with any precious metal such as gold (9 to 24 kt., including white gold), platinum, silver, combinations thereof, non-precious jewelry metals, such as brass and other alloys, as well as the newer alternative metals used in bridal set, such as titanium, cobalt, palladium and the like.

The wedding band 30 of the illustrated embodiment includes a band 32 of a desired configuration. Preferably the jeweler will have multiple wedding bands 30 having various band 32 configurations. Preferably at least a group of bands 32 will have configurations which complement a corresponding group of shanks 14 such that they can be mixed and matched in a complementary manner.

The engagement ring 12, or ring assembly, includes a shank 14 and a head 20. The shank 14 is defined by a band 15 with a head mounting area 16. In the illustrated embodiment, the band 15 is continuous and the head mounting area 16 is defined within a recess 17 of the band 15. The band 15 may have various other configurations, and preferably, a jeweler would have multiple shanks 14 with different band configurations. A through hole 18 is defined through the band 15 in the head mounting area 16, the through hole 18 preferably extending perpendicular to the axis of the band 15. The through hole 18 may be formed during forming of the band 15, e.g. casting of the band with a through hole, or may be formed utilizing a post-forming process, for example, drilling of the band 15.

The head 20 includes a mount 22 configured to maintain one or more diamonds or other jewels. A post 24 extends from a rear portion of the mount 22 and is configured to engage the through hole 18. To ensure a reliable interconnection between the head 20 and shank 14 during viewing of the ring assembly 12, but to allow the components to be disassembled and arranged with other components, the head 20 and shank 14 are provided with a complementary threaded interconnection.

An exemplary method of defining internal threads 19 in the through hole 18 and external threads 25 on the post 24 will be described with respect to FIGS. 3 and 4. It is understood that the complementary threads may be otherwise formed. For example, the internal threads 19 and external threads 25 may be formed during the formation of the respective components or may be formed during alternative post-formation methods.

Figure 3:
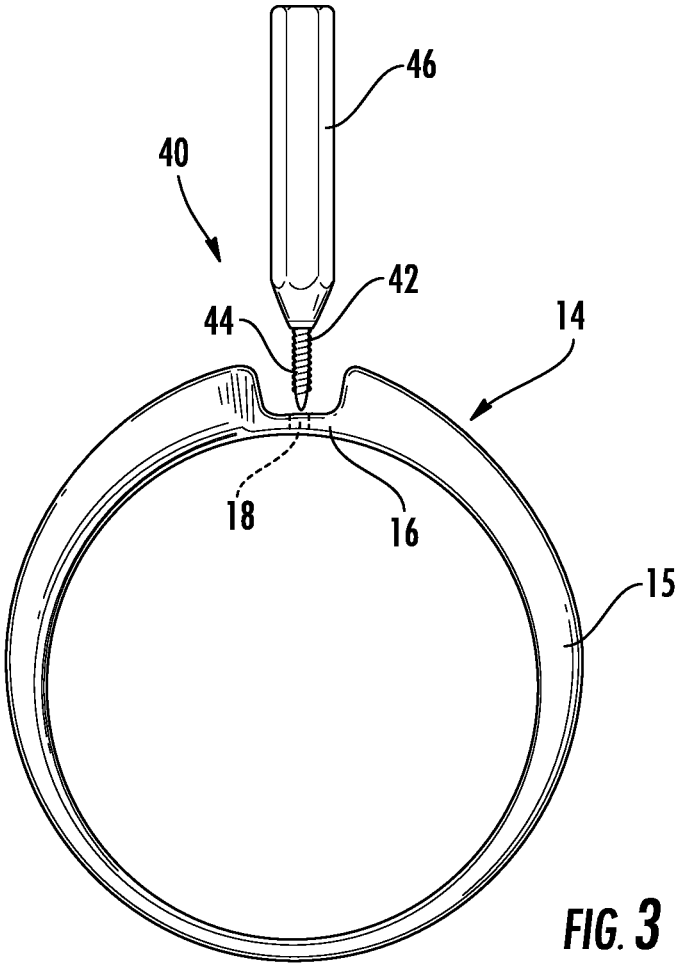
FIG. 3 is a schematic view illustrating an exemplary tapping of the shank of exemplary bridal set of FIG. 2.

Referring to FIG. 3, an exemplary method of forming the internal threads 19 within the through hole 18 will be described. The threads are created using a thread tap 40. The thread tap will generally comprise a hardened shaft 42 with an external thread forming area 44 and a handle 46 or tap handler. The thread tap 40 is selected such that its size complements the size of the through hole 18. The thread tap 40 is set relative to the shank 14, which may be held in a vise (not shown) or the like, with the tap shaft 42 preferably at 90 degrees relative to the axis of the band 15. The tap 40 is then twisted using the handle 46 or handler such that the thread forming area 44 engages within the through hole 18. Depending on the configuration of the thread tap 40, the twisting motion may be in a continuous direction or an oscillation motion. Twisting is continued until the shaft 42 passes through the through hole 18. The tap 40 is then removed and any shavings are wiped away from the through hole.

Figure 4:
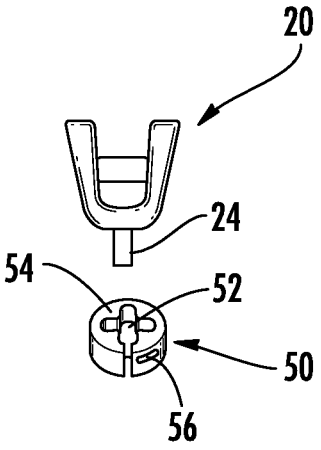
FIG. 4 is a schematic view illustrating an exemplary threading of the post of the head of the exemplary bridal set of FIG. 2.

Referring to FIG. 4, an exemplary method of forming the external threads 25 on the post 24 will be described. To begin, the tip of the post 24 may be sharpened and brushed with cutting oil. The post 24 is set perpendicular to a threading die 50 which has a through bore 52 and an internal thread forming area 54. The die 50 may have an adjustment mechanism 56 to adjust the diameter of the bore 52. The post 24 is twisted into the bore 52 of the die 50. Depending on the configuration of the die 50, the twisting motion may be in a continuous direction or an oscillation motion. Twisting is continued until a desired length of threads 25 is achieved, which may be all or less than all of the length of the post 24. The post 24 is removed from the die 50 and any shavings from the post 24 are wiped away. The shank 14 and head 20 may be treated, for example, chemically treated with rhodium.

Figure 5:
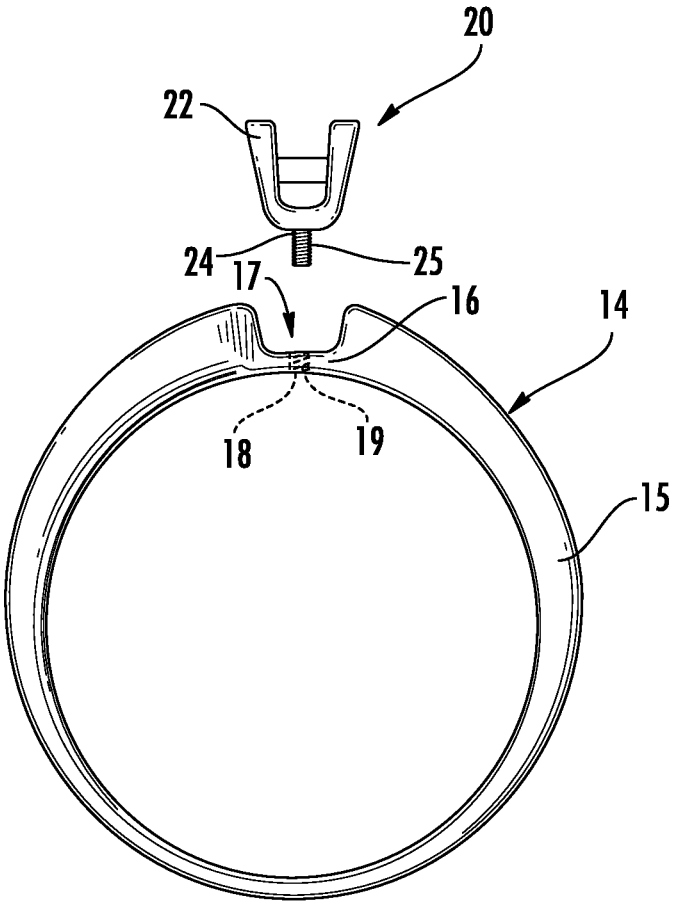
FIG. 5 is a side elevation view illustrating alignment of the head with the shank of the exemplary bridal set.
Figure 6:
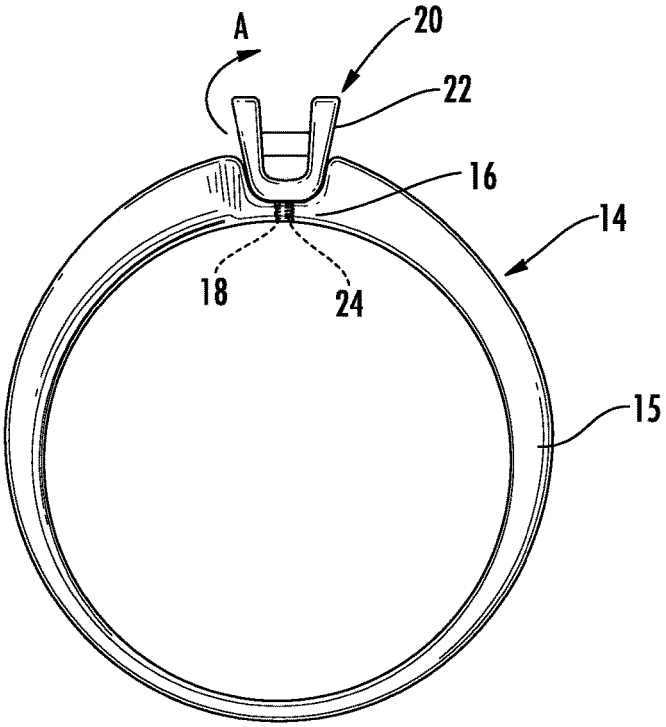
FIG. 6 is a side elevation view illustrating the head interconnected with the shank of the exemplary bridal set.

With reference to FIGS. 5 and 6, once the threads 19 and 25 are formed, the head 20 may be temporarily interconnected to the shank 14 by aligning the post 24 with the through hole 18 and rotating the head 20 relative to the shank 14, as indicated by arrow A. The post 24 preferably has a length such that it will not extend beyond the thickness of the band 15 when the mount 22 is seated on the head mounting area 16.

Such temporary interconnection allows a customer to physically see the ring assembly 12 including how the head 20 and shank 14 look together and to view it on their hand for a true life experience. The customer may also look at an assembled ring assembly 12 in conjunction with various complementary bands 30. Trying of the head 20 with a different shank 14, or vice versa, simply requires unthreading of the head 20 from the shank 14 and rethreading in a different combination. This is helpful when the customer is considering various combinations in person. The system is also helpful for the customer that has picked what is believed to be the right combination in an electronic format, e.g. on-line or application based, and wants to confirm the combination in person. The threaded interconnection provides a secure structure which may be tried on and otherwise viewed in person.

Figure 7:
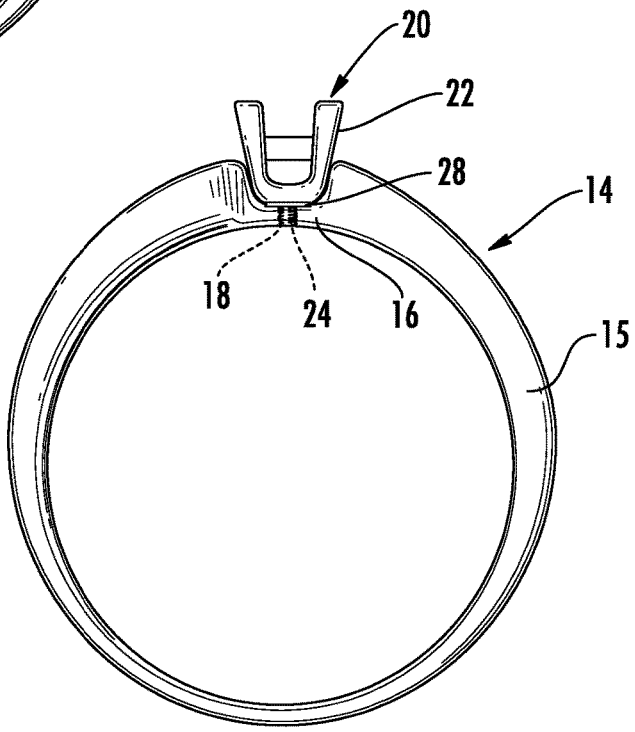
FIG. 7 is a side elevation view illustrating the head fixed with the shank of the exemplary bridal set.

Once customer decides on a combination they like, the selected head 20 may be permanently fixed to the selected shank 14, for example, via a weld material 28 or soldering as illustrated in FIG. 7. It is believed that the threaded configuration also allows for a stronger welding or soldering operation to take place. Other means of providing the final ring assembly, including casting the selected mount and shank together as a single component, may alternatively be utilized.

The system and method described herein uniquely allows for the adaptation of a wide variety of heads to a wide variety of shanks in a way that permits the adaptation of the head-shank combination to a wide variety of wedding or anniversary bands, regardless of whether the head is round, square, or some other geometric shape. Referring again to the example of 18 varieties, the present system allows a jeweler to stock one of each style of head 20, shank 14 and band 30 as interchangeable parts that could be combined in the showroom to demonstrate any one of the 5,832 possible combinations. The 5,832 complete sets may be demonstrate while requiring the jeweler to only stock 18 heads, 18 shanks and 18 bands, or 54 pieces of display inventory.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A method of demonstrating various ring assemblies, the method comprising:

selecting a first shank from a plurality of shanks, each shank having a band defining a head mounting area within a recess of the band, said recess having a base and sidewalls, and a through hole defined through the band in the base of said head mounting area, the through hole defining internal threads; and selecting a first head from a plurality of heads, each head including a mount with a post extending therefrom, the post including an area of external threads, wherein said heads comprise a plurality of different geometric shape cross-sections, at least one head having a geometric cross-section different than the geometric shape of the corresponding cross-section defined by the base and sidewalls of the recess of at least one band; and rotatably interconnecting the external threads of the first head with the internal threads of the first shank to releasably secure the first head to the first shank with at least a portion of the mount positioned within the recess of the band;

wherein said mount of each head, and said base and sidewalls of each recess, are dimensioned to allow rotation of said head within said recess to interconnect said threads.

2. The method according to claim 1, further comprising the steps of:

unthreading the first head from the first shank and thereafter threading the first head to a second shank from the plurality of shanks.

3. The method according to claim 1 further comprising the steps of:

unthreading the first head from the first shank and thereafter threading a second head of the plurality of heads to the first shank.

4. The method according to claim 1 further comprising the step of positioning a first complementary band selected from a plurality of complementary bands adjacent the interconnected first head and first shank.

5. The method according to claim 1 further comprising the step of permanently fixing a selected head which is rotatably interconnected with a selected shank.

6. The method according to claim 5 wherein the step of permanently fixing the selected head includes welding or soldering.

7. The method according to claim 1, wherein at least one mount is dimensioned to allow rotation of said head until said mount contacts said sidewalls.

* * * * *